US009207612B2

(12) United States Patent
Hayakawa et al.

(10) Patent No.: US 9,207,612 B2
(45) Date of Patent: Dec. 8, 2015

(54) IMAGE FORMING APPARATUS AND METHOD OF MANUFACTURING THE SAME

(71) Applicant: Brother Kogyo Kabushiki Kaisha, Nagoya-shi, Aichi-ken (JP)

(72) Inventors: Masahiko Hayakawa, Kitanagoya (JP); Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/495,998

(22) Filed: Sep. 25, 2014

(65) Prior Publication Data

US 2015/0086223 A1 Mar. 26, 2015

(30) Foreign Application Priority Data

Sep. 25, 2013 (JP) ..... 2013-198121

(51) Int. Cl.

| | |
|---|---|
| ***G03G 15/00*** | (2006.01) |
| *G03G 15/043* | (2006.01) |
| *G03G 15/16* | (2006.01) |
| *G03G 21/18* | (2006.01) |

(52) U.S. Cl.

CPC ..... *G03G 15/55* (2013.01); *G03G 15/043* (2013.01); *G03G 15/1675* (2013.01); *G03G 15/75* (2013.01); *G03G 21/1892* (2013.01)

(58) Field of Classification Search

USPC ..... 399/12

See application file for complete search history.

(56) References Cited

U.S. PATENT DOCUMENTS

| | | | | |
|---|---|---|---|---|
| 4,577,953 | A * | 3/1986 | Narukawa | 399/36 |
| 5,327,200 | A * | 7/1994 | Sakakibara et al. | 399/303 |
| 6,909,856 | B2 * | 6/2005 | Crichton | 399/12 |
| 7,498,107 | B2 * | 3/2009 | Takegawa | 430/56 |
| 2006/0140648 | A1 | 6/2006 | Takegawa | |

FOREIGN PATENT DOCUMENTS

| | | | |
|---|---|---|---|
| JP | H02-077766 | A | 3/1990 |
| JP | 2002-244534 | A | 8/2002 |
| JP | 2006-178353 | A | 7/2006 |
| JP | 2007-057987 | A | 3/2007 |

* cited by examiner

*Primary Examiner* — Clayton E LaBalle
*Assistant Examiner* — Warren K Fenwick
(74) *Attorney, Agent, or Firm* — Banner & Witcoff, Ltd.

(57) ABSTRACT

An image forming apparatus includes a controller configured to perform operations including: controlling an exposing unit to expose a first ratio to a full scan width and thus to form a first exposed section, and to expose a second ratio smaller than the first ratio thus to form a second exposed section, controlling a detecting member to acquire: a first voltage in a case where a first test current flows in the first exposed section; a second voltage in a case where the first test current flows in the second exposed section; a third voltage in a case where a second test current larger than the first test current flows in the first exposed section; and a fourth voltage in a case where the second test current flows in the second exposed section; and identifying the photosensitive member based on the first to fourth voltages.

14 Claims, 10 Drawing Sheets

UPPER
LOWER
FRONT
REAR
CONT-
ROLLER
1
10
12
13
14
15
16
20
21
22
30
40
50
50A
50B
51
52
53
54
55
56
57
70
71
72
73
74
80
81
82
100
103
S

IMAGE FORMING APPARATUS AND METHOD OF MANUFACTURING THE SAME

CROSS-REFERENCE TO RELATED APPLICATION

This application claims priority from Japanese Patent Application No. 2013-198121 filed on Sep. 25, 2013, the entire subject matter of which is incorporated herein by reference.

TECHNICAL FIELD

This disclosure relates to an electrophotographic image forming apparatus and a method of manufacturing the electrophotographic image forming apparatus.

BACKGROUND

An electrophotographic image forming apparatus is configured to expose photosensitive members, thereby forming electrostatic latent images on the surfaces of the photosensitive members, and supply developer to the electrostatic latent images, thereby forming developer images, and the image forming apparatus transfers the developer images onto a recording sheet or the like, thereby forming an image on the recording sheet or the like. In this image forming apparatus, in order to form a good image, it is necessary to appropriately set control parameters such as a transfer current, a charging bias, and a discharging light amount necessary after transfer. These control parameters depend on the characteristics of the photosensitive members.

Since the characteristics of photosensitive members slightly differ from manufacturer to manufacturer, or from manufacturing lot to manufacturing lot, in the background art, in order to identify photosensitive members, identification information items using slit arrangements are provided to members rotating according to rotation of photosensitive members or IC tags are provided to photosensitive members or cartridges including photosensitive members.

SUMMARY

However, according to the configurations as disclosed in the background art, it is necessary to incorporate information for identifying photosensitive members into photosensitive members or cartridges including photosensitive members, and is troublesome in a manufacturing process.

In view of the above, this disclosure is provide at least an image forming apparatus capable of identifying photosensitive members by a simple configuration, and a method of manufacturing the image forming apparatus after identifying specific photosensitive members.

An image forming apparatus according to one aspect of this disclosure includes a photosensitive member, a charger configured to charge the photosensitive member, an exposing unit configured to expose the photosensitive member, a developing member configured to supply developer to the photosensitive member, an image forming unit that includes a detecting member configured to flow current between the detecting member and the photosensitive member, a controller configured to control operations of the image forming unit, and a casing, and the image forming apparatus configured to be able to identify the photosensitive member. The controller performs operations comprising: controlling the exposing unit to expose a first ratio to a full scan width of the photosensitive member and thus to form a first exposed section, and to expose a second ratio smaller than the first ratio thus to form a second exposed section, controlling the detecting member to acquire: a first voltage in a case where a first test current flows in the first exposed section; a second voltage in a case where the first test current flows in the second exposed section; a third voltage in a case where a second test current larger than the first test current flows in the first exposed section; and a fourth voltage in a case where the second test current flows in the second exposed section; and identifying the photosensitive member based on the first to fourth voltages.

An image forming apparatus according to another aspect of this disclosure includes a photosensitive member, a charger configured to charge the photosensitive member, an exposing unit configured to expose the photosensitive member, a developing member configured to supply developer to the photosensitive member, an image forming unit that includes a detecting member configured to flow current between the detecting member and the photosensitive member, and a controller configured to control operations of the image forming unit, and the image forming apparatus configured to be able to identify the photosensitive member. The controller performs operations comprising: controlling the exposing unit to expose a first ratio to a full scan width of the photosensitive member and to thus form a first exposed section, and to expose a second ratio smaller than the first ratio thus to form a second exposed section, controlling the detecting member to acquire: a first current in a case of applying a first test voltage to the first exposed section; a second current in a case of applying the first test voltage to the second exposed section; a third current in a case of applying a second test voltage larger than the first test voltage to the first exposed section; and a fourth current in a case of applying the second test voltage to the second exposed section; and identifying the photosensitive member based on the first to fourth currents.

A method, according to another aspect of this disclosure, of manufacturing an image forming apparatus includes a photosensitive member, a charger configured to charge the photosensitive member, an exposing unit configured to expose the photosensitive member, a developing member configured to supply developer to the photosensitive member, an image forming unit that includes a detecting member configured to flow current between the detecting member and the photosensitive member. The method comprises controlling the exposing unit to expose a first ratio to a full scan width of the photosensitive member thus to form a first exposed section; controlling the detecting member to acquire a first voltage in a case where a first current flows in the first exposed section and a third voltage in a case where a second current larger than the first current flows in the first exposed section; controlling the exposing unit to expose a second ratio to the full scan width of the photosensitive member, thus to form second exposed section, the second ratio being smaller than the first ratio; controlling the detecting member to acquire a second voltage in a case where the first current flows in the second exposed section and a fourth voltage in a case where the second current flows in the second exposed section; identifying, in a case where a difference between the first voltage and the second voltage is smaller than a difference between the third voltage and the fourth voltage, the photosensitive member as an accepted product; and identifying, in a case where the difference between the first voltage and the second voltage is not smaller than the difference between the third voltage and the fourth voltage, the photosensitive member as an rejected product.

In the image forming apparatus of this disclosure, in order to identify the photosensitive members, it is unnecessary to incorporate information for identifying each photosensitive member into the corresponding photosensitive member. Therefore, at least it is possible to identify the photosensitive members by a simple configuration.

BRIEF DESCRIPTION OF THE DRAWINGS

The foregoing and additional features and characteristics of this disclosure will become more apparent from the following detailed descriptions considered with the reference to the accompanying drawings, wherein:

FIG. 4A is a graph illustrating the relation between the transfer current and transfer bias of a type "PHOTOSENSITIVE MEMBER A", and FIG. 4B is a graph illustrating the relation between the transfer current and transfer bias of a type "PHOTOSENSITIVE MEMBER B";

FIG. 8A is a graph illustrating the relation between the transfer current and transfer bias of a type "PHOTOSENSITIVE MEMBER A", and FIG. 8B is a graph illustrating the relation between the transfer current and transfer bias of a type "PHOTOSENSITIVE MEMBER B";

DETAILED DESCRIPTION

First Embodiment

Figure 1:
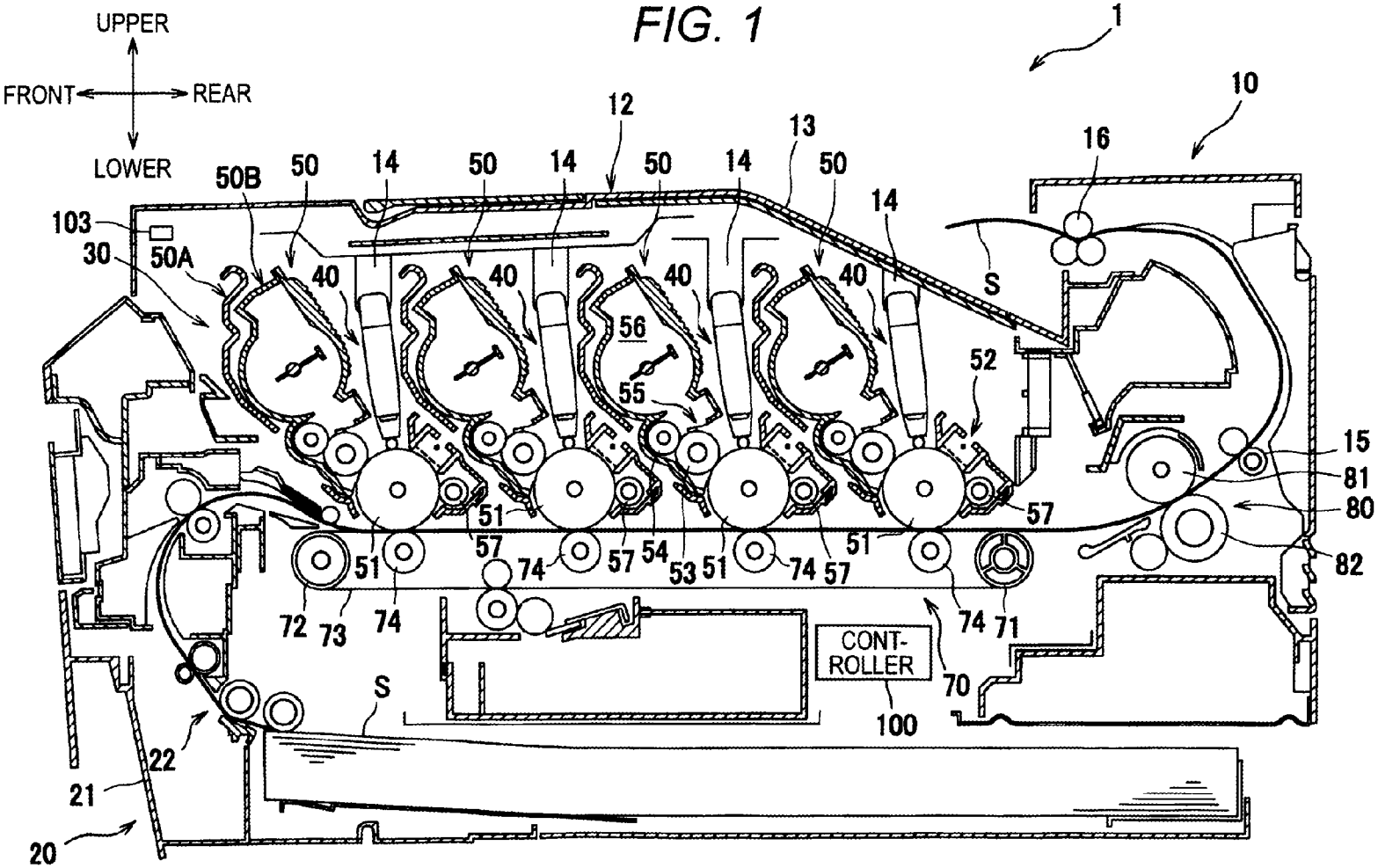
FIG. 1 is a view schematically illustrating the configuration of a color printer which is an example of an image forming apparatus according to an illustrative embodiment of this disclosure.

Hereinafter, as an example of an image forming apparatus according to a first illustrative embodiment of this disclosure, a color printer 1 will be described in detail with reference to relevant drawings. In the following description, directions of the color printer 1 refer to the directions as seen from a user facing to the color printer during its use. To be more specific, referring to FIG. 1, a left-side direction and a right-side direction of the drawing sheet are referred to as a "front side" and a "rear side" of the color printer, respectively. Also, a direction toward the viewer of FIG. 1 is referred to as a "right side", and a direction away from a viewer of FIG. 1 is referred to as a "left side". An upward and downward direction in FIG. 1 is referred to as a "vertical direction" or an "upward and downward direction".

<Schematic Configuration of Color Printer>

As shown in FIG. 1, the color printer 1 includes a paper feeding unit 20, and an image forming unit 30, inside a casing 10. On the upper side of the casing 10, an upper cover 12 is configured as an example of a cover member for opening or closing the upper portion of the casing 10, so as to be rotatable upward or downward on the rear side. On the upper front side of the inside of the casing 10, a cover sensor 103 is provided as an example of a sensor for detecting opening or closing of the upper cover 12.

The paper feeding unit 20 is provided at a lower portion of the inside of the casing 10, and mainly includes a paper feeding tray 21 which accommodates paper sheets S as examples of a transfer medium, and a feeding mechanism 22 which feeds each of the paper sheet S as an example of a recording sheet from the paper feeding tray 21 into the image forming unit 30. The feeding mechanism 22 separates the paper sheets S stored in the paper feeding tray 21, one by one, and feeds each paper sheet S into the image forming unit 30.

The image forming unit 30 mainly includes four LED unit 40 which are examples of an exposing unit, four process unit 50, a transfer unit 70, and a fixing unit 80.

The LED unit 40 are disposed so as to face the upper sides of photosensitive drums 51 which are examples of a photosensitive member. Each LED unit 40 includes a plurality of light emitting diodes (LEDs) (not shown) arranged in the left-right direction on the lower end of the corresponding LED unit. The light emitting devices of the LED unit 40 blink based on image data, thereby exposing the surfaces of the photosensitive drums 51. Also, the LED unit 40 are configured to be held on the upper cover 12 through holding unit 14, thereby separating from the photosensitive drums 51 if the upper cover 12 is opened.

The process unit 50 are configured to be disposed between the upper cover 12 and the paper feeding tray 21 in parallel in the front-rear direction and be removable from the casing 10 if the upper cover 12 is open. Each process unit 50 mainly includes a photosensitive drum 51, a charger 52 for charging the photosensitive drum 51, a developing roller 53 which is an example of a developing member for supplying toner as an example of developer onto the photosensitive drum 51, a feeding roller 54, a layer-thickness regulating blade 55, a toner container 56 which contains positively charged toner, and a cleaning roller 57 which can temporarily remove toner on the photosensitive drum 51 or return toner held on the cleaning roller to the photosensitive drum 51, according to a current between the cleaning roller and the photosensitive drum 51.

Figure 2:
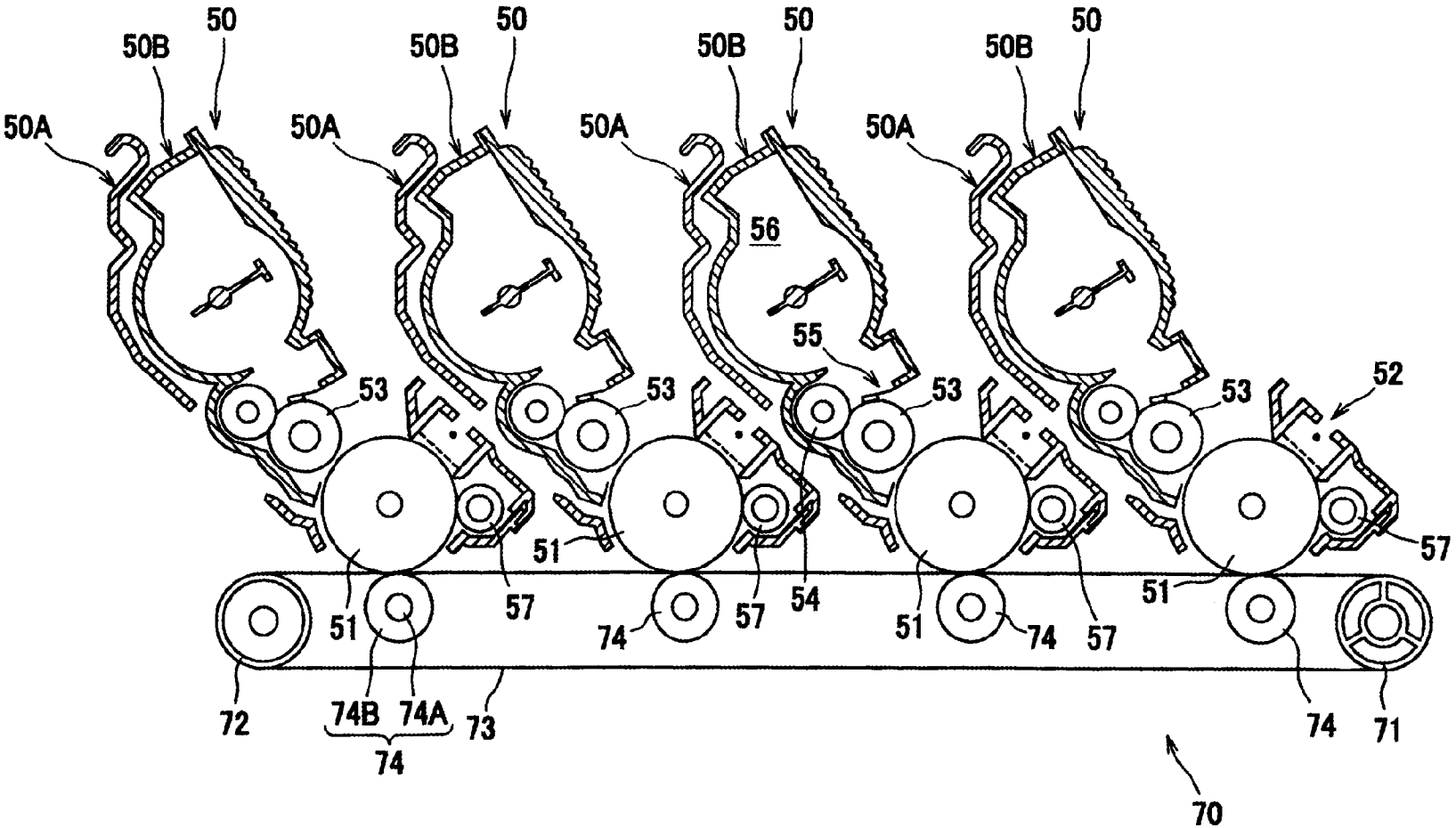
FIG. 2 is a view for explaining developing rollers separated from photosensitive members.

As well known, each process unit 50 includes a photosensitive member cartridge 50A which supports a corresponding photosensitive drum 51, and a developing cartridge 50B which contains corresponding toner while supporting the a corresponding developing roller 53, and is removably attached to the photosensitive member cartridge 50A. Although the mechanism is not described in detail, as well known, the developing cartridges 50B are configured to be movable upward or downward with respect to the corresponding photosensitive drums 51, respectively. In a case where printing is not performed, or monochrome printing is performed, some or all of the developing cartridges 50B can move upward, thereby separating the developing rollers 53 from corresponding photosensitive drums 51 as shown in FIG. 2.

Referring to FIG. 1 again, the transfer unit 70 is provided between the paper feeding unit 20 and the process unit 50, and mainly includes a driving roller 71, a driven roller 72*a*, conveyance belt 73 which is composed of an endless belt, and four transfer rollers 74 which are examples of a detecting member. The conveyance belt 73 is stretched tightly between the driving roller 71 and the driven roller 72, such that the outer surface of the conveyance belt 73 faces the photosensitive drums 53 and the conveyance belt 73 is interposed between the photosensitive drums 53 and the transfer rollers 74 disposed on the inner side of the conveyance belt 73.

If currents flow between the transfer rollers 74 and the photosensitive drums 51, toner images formed on the surfaces of the photosensitive drums 51 can be transferred onto a paper sheet S which is being conveyed by the conveyance belt 73. Each of the transfer rollers 74 is configured to include a metal shaft 74A, and a roller portion 74B which is formed of ion conductive rubber so as to cover the shaft 74A (see FIG. 2).

The fixing unit 80 is provided on the rear side relative to the process unit 50 and the transfer unit 70, and mainly includes a heating roller 81, and a pressing roller 82 which is disposed to face the heating roller 81 and presses the heating roller 81.

In the image forming unit 30 configured as described above, first, the surfaces of the photosensitive drums 51 are uniformly charged by the chargers 52, and then are exposed to LED light radiated from the LED unit 40. As a result, the potentials of exposed portions decrease, whereby electrostatic latent images based on image data are formed on the photosensitive drums 51, respectively.

Next, the toner in the toner containers 56 is fed to the developing rollers 63 by rotation of the feeding rollers 54, and enters gaps between the developing rollers 53 and the layer-thickness regulating blades 55 by rotation of the developing rollers 53, thereby being carried as thin layers having a uniform thickness on the developing rollers 53.

Thereafter, if the developing rollers 53 come into contact with the photosensitive drums 51, the toner carried on the photosensitive drums 51 is supplied to the electrostatic latent images formed on the photosensitive drums 51. As a result, the toner is selectively carried on the photosensitive drums 51, whereby the electrostatic latent images are visualized. Thereafter, reversal development is performed, whereby toner images are formed.

Next, a paper sheet S fed on the conveyance belt 73 passes between the photosensitive drums 51 and the transfer rollers 74, whereby the toner images (developer images) formed on the photosensitive drums 51 are transferred onto the paper sheet S.

Thereafter, the paper sheet S passes between the heating roller 81 and the pressing roller 82, whereby a toner image on the paper sheet S is thermally fixed.

On the rear side from the fixing unit 80, a conveying roller 15 is provided, and above the fixing unit 80, a discharging roller 16 is provided. If the paper sheet S is discharged from the fixing unit 80, the paper sheet S is discharged to the outside of the casing 10 by the conveying roller 15 and the discharging roller 16, and is accumulated on a paper discharge tray 13.

<Configuration for Identifying Photosensitive Drums>

The color printer 1 is configured to include a control unit 100 for controlling the operation of the image forming unit 30, and be able to use the control unit 100 to identify the kind of the photosensitive drums 51 (here, it is assumed a case where the kind of the photosensitive drums 51 is any one of two kinds, that is, "PHOTOSENSITIVE MEMBER A" or "PHOTOSENSITIVE MEMBER B") included in the process unit 50 installed in the casing 10.

Figure 3:
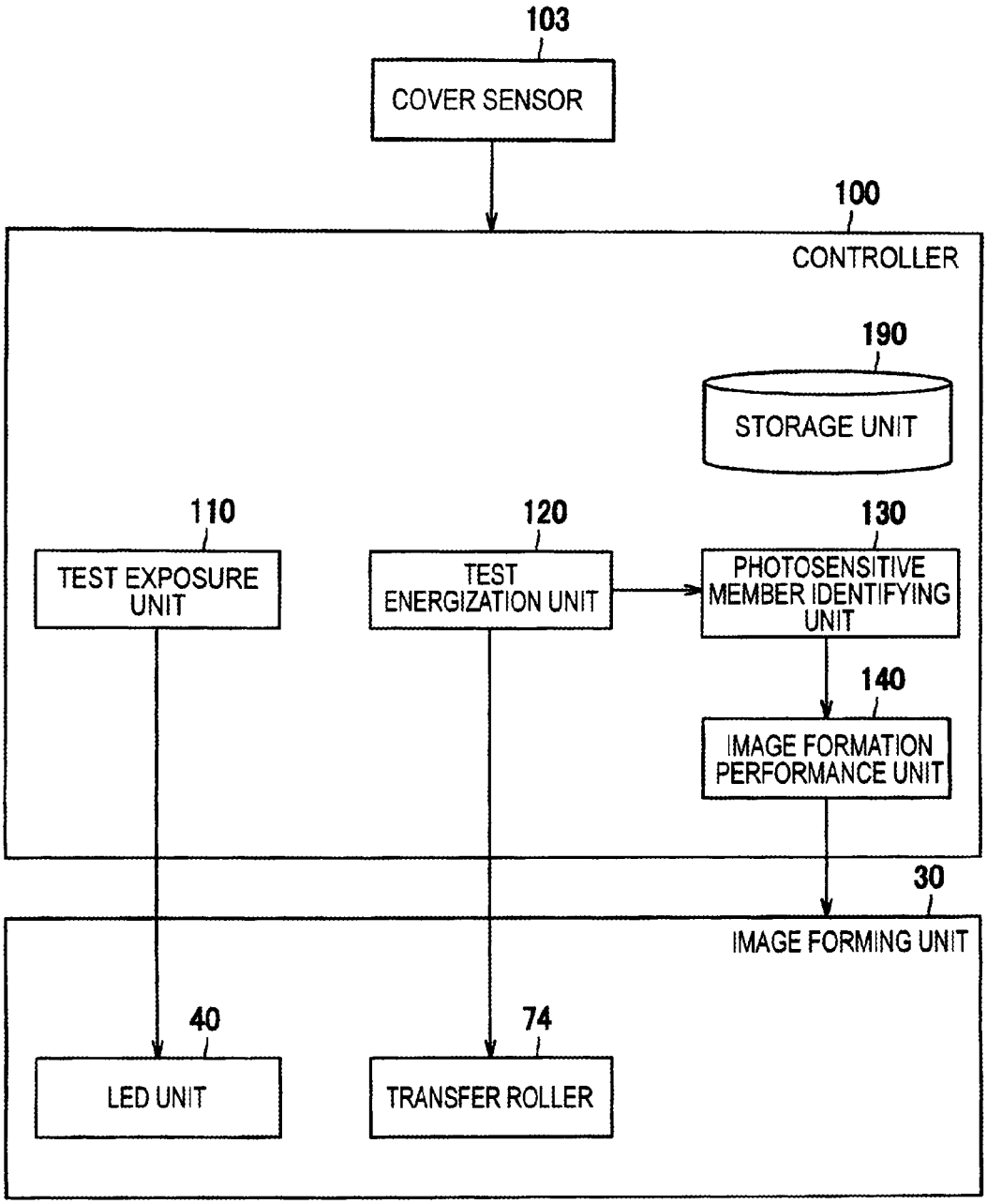
FIG. 3 is a block diagram illustrating a control unit.

As shown in FIG. 3, the control unit 100 includes a test exposure unit 110, a test energization unit 120, a photosensitive-member identifying unit 130, an image formation performance unit 140, and a storage unit 190, as components for identifying the photosensitive drums 51.

The test exposure unit 110 controls each LED unit 40 such that the LED unit 40 exposes a first ratio of a corresponding photosensitive drum 51 to the full scan width, thereby forming a first exposed section, and exposes a second ratio smaller than the first ratio, thereby forming a second exposed section. The values of the first ratio and the second ratio are arbitrary, and as the difference between the first ratio and the second ratio increases, the difference between voltage values or current values acquired increases, so it becomes easier to correctly identify the photosensitive members. In the present illustrative embodiment, in order to make the difference between the first ratio and the second ratio as large as possible, the first ratio is set to 100%, and the second ratio is set to 0%.

The test energization unit 120 performs constant current control on the transfer rollers 74, thereby acquiring a first voltage V1 in a case where a first test current IT1 flows in the first exposed section, a second voltage V2 in a case where the first test current IT1 flows in the second exposed section, a third voltage V3 in a case where a second test current IT2 larger than the first test current IT1 flows in the first exposed section, and a fourth voltage V4 in a case where the second test current IT2 flows in the second exposed section.

The test energization unit 120 outputs the acquired first to fourth voltages V1 to V4 to the photosensitive-member identifying unit 130.

The photosensitive-member identifying unit 130 identifies the photosensitive members based on the first voltage V1, the second voltage V2, the third voltage V3, and the fourth voltage V4 acquired by the test energization unit 120. In the present illustrative embodiment, in order to compare the difference between the first voltage V1 and the second voltage V2, and the difference between the third voltage V3 and the fourth voltage V4, the photosensitive-member identifying unit 130 calculates a comparison value D1 as follows.

$$D1=|V1-V2|-|V3-V4|$$

Thereafter, the photosensitive-member identifying unit 130 compares the comparison value D1 with a predetermined threshold value Vth. In a case where the comparison value D1 is larger than the threshold value Vth, the photosensitive-member identifying unit 130 identifies the kind of the photosensitive drums 51 as "PHOTOSENSITIVE MEMBER A". Meanwhile, in a case where the comparison value D1 is not larger than the threshold value Vth, the photosensitive-member identifying unit 130 identifies the kind of the photosensitive drums 51 as "PHOTOSENSITIVE MEMBER B". The photosensitive-member identifying unit 130 outputs the result of the identification of the photosensitive drums 51 to the image formation performance unit 140.

Figure 4A:
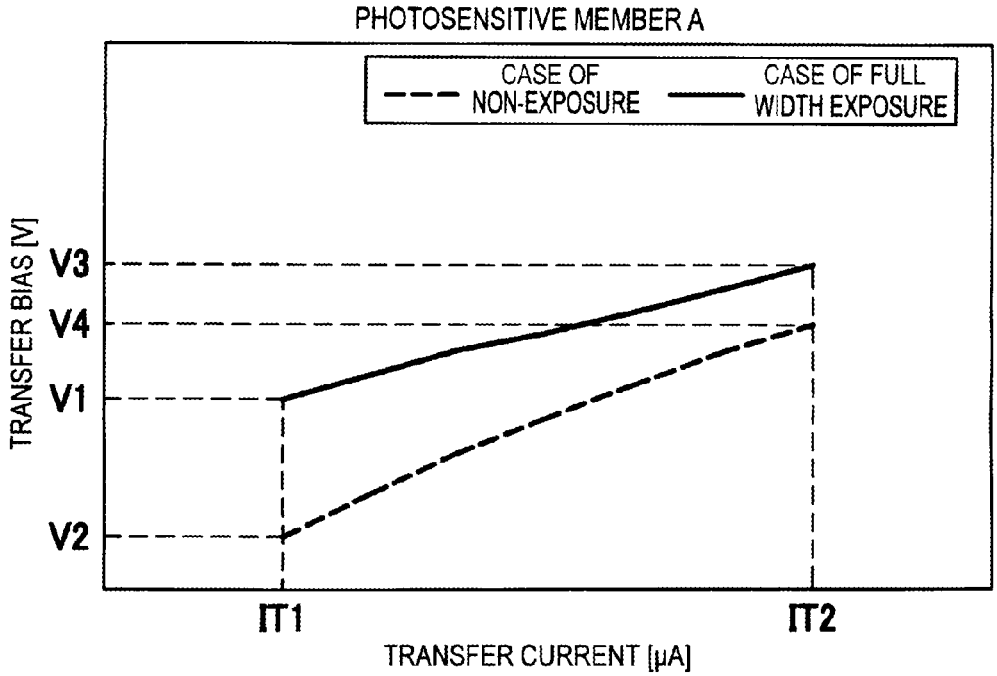
FIGS. 4A and 4B are views for explaining identification of photosensitive members according to a first illustrative embodiment, and more specifically.
Figure 4B:
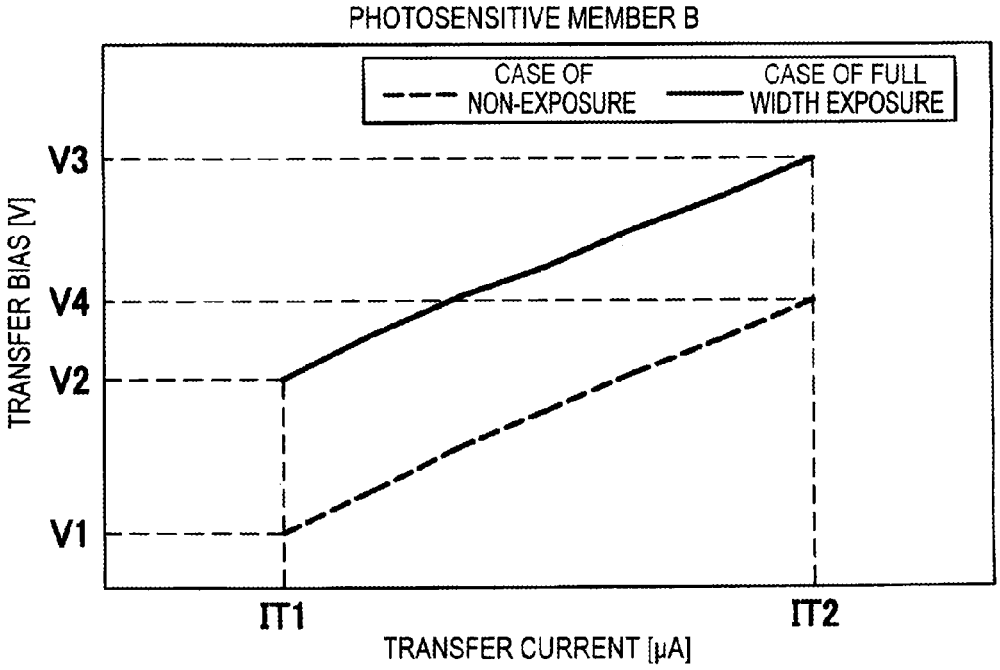

Now, the reason why it is possible to identify the kind of the photosensitive drums 51 by the comparison value D1 will be described. Referring to FIGS. 4A and 4B illustrating the relations between the transfer currents and the transfer biases (voltages), the value of the transfer bias of a photosensitive member during non-exposure is different from that during full width exposure. This is because if the surface of the photosensitive member is exposed, the surface potential varies. In general, in case of many photosensitive members, as shown in FIG. 4B, graphs during non-exposure are substantially parallel to graphs during full width exposure. However, in case of some photosensitive members, as shown in FIG.

4A, the slopes of graphs during full width exposure are smaller than the slopes of graphs during non-exposure. Therefore, these slope differences can be used to identify the photosensitive members.

Also, this disclosure does not identify the photosensitive members only based on the slope of a graph during full width exposure. This disclosure identifies the photosensitive members based on the difference between the slope of a graph during full width exposure and the slope of a graph during non-exposure, so as not to receive an influence of a variation in the electric resistance of the transfer rollers 74 due to a variation in humidity. The electric resistance of the transfer rollers 74 varies according to humidity, and especially, in a case where an ion conductive material is used in the transfer rollers 74 like in the present illustrative embodiment, the electric resistance of the transfer rollers 74 significantly varies due to a variation in humidity. Therefore, the slopes in the current-voltage characteristics shown in FIGS. 4A and 4B are significantly influenced by humidity. For this reason, even if the absolute values of the slopes are used for identifying photosensitive members, it may be impossible to correctly identify the photosensitive drums 51. However, even if humidity varies, a difference occurs between the current-voltage characteristic during non-exposure and the current-voltage characteristic during full width exposure. Therefore, it is possible to correctly identify the photosensitive drums 51 by verifying a value correlated to the slope difference (the comparison value D1 in the present illustrative embodiment).

The image formation performance unit 140 is configured to acquire appropriate control parameters from the storage unit 190, according to the kind of the photosensitive members identified by the photosensitive-member identifying unit 130, and use the control parameters to control the image forming unit 30, thereby performing image processing.

The storage unit 190 appropriately stores a variety of threshold values necessary for the operation of the control unit 100 of the present illustrative embodiment, and values necessary for calculations. Also, the storage unit 190 stores control parameters for controlling the image forming unit 30, in association with the kinds of photosensitive members. Also, examples of the control parameters include a transfer current, a transfer bias, a cleaning bias to be applied to the cleaning rollers 57, a charging bias to be applied to the chargers 52, the exposure outputs of the LED unit 40, and the like. Also, in a case where there are dischargers for exposing the photosensitive drums 51, thereby discharging the photosensitive drums 51, examples of the control parameters also include the discharging light amounts of the dischargers.

An operation which is performed for identifying the photosensitive drums 51 in the color printer 1 configured as described above will be described. Examples of triggers to identify the photosensitive drums 51 include reception of a print job, opening of the upper cover 12, or the like. Here, a case where a trigger to identify the photosensitive drum 51 is reception of a print job will be described.

Figure 5:
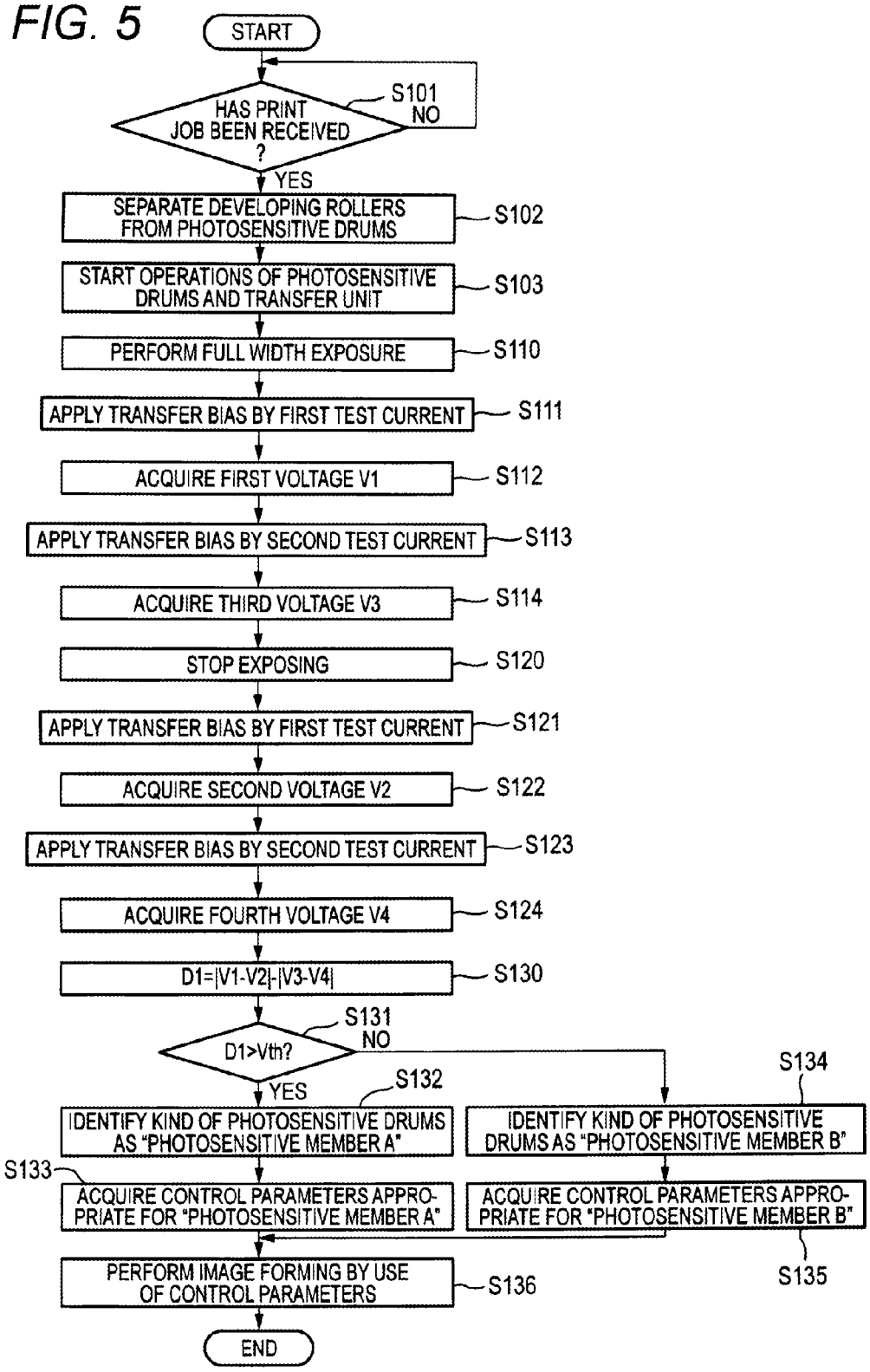
FIG. 5 is a flow chart illustrating a photosensitive member identifying process which is performed according to the first illustrative embodiment in a case of receiving a print job.

As shown in FIG. 5, if a print job is received ("Yes" in STEP S101), in STEP S102, the color printer 1 separates the developing rollers 53 from the photosensitive drums 51. As a result, during a process of identifying the photosensitive drums 51, toner is surely suppressed from moving from the developing rollers 53 onto the photosensitive drums 51.

Next, in STEP S102, the control unit 100 starts the operations of the photosensitive drums 51 and the transfer rollers 74. Here, the operations of the photosensitive drums 51 and the transfer rollers 74 are the rotating operations of the photosensitive drums 51 and the transfer rollers 74, not operations for image forming. Also, at this time, a charging bias is applied to the chargers 52.

Next, in STEP S110, the test exposure unit 110 controls the LED unit 40 such that the ratio of 100% (full widths) to the scan width of each photosensitive drum 51 is exposed. While exposure is being performed, the test energization unit 120 performs constant current control on the transfer rollers 74 by the first test current IT1, thereby applying a transfer bias, in STEP S111, and then acquires the first voltage V1 at that moment in STEP S112. Thereafter, the test energization unit 120 performs constant current control on the transfer rollers 74 by the second test current IT2, thereby applying a transfer bias, in STEP S113, and then acquires the third voltage V3 at that moment in STEP S114.

Next, in STEP S120, the test exposure unit 110 controls the LED unit 40, thereby stopping exposing of the photosensitive drums 51. Then, in a state where the exposing has been stopped, the test energization unit 120 performs constant current control on the transfer rollers 74 by the first test current IT1, thereby applying a transfer bias, in STEP S121, and then acquires the second voltage V2 at that moment in STEP S122. Thereafter, the test energization unit 120 performs constant current control on the transfer rollers 74 by the second test current IT2, thereby applying a transfer bias, in STEP S123, and then acquires the fourth voltage V4 at that moment in STEP S124.

If the test energization unit 120 acquires the first to fourth voltages V1 to V4 in the above described way, in STEP S130, the photosensitive-member identifying unit 130 calculates the comparison value D1 as follows.

$$D1=|V1-V2-|V3-V4|$$

Next, in STEP S131, the photosensitive-member identifying unit 130 compares the comparison value D1 with the threshold value Vth. In a case where the comparison value D1 is larger than the threshold value Vth ("Yes" in STEP S131), in STEP S132, the photosensitive-member identifying unit 130 identifies the kind of the photosensitive drums 51 as "PHOTOSENSITIVE MEMBER A". Thereafter, in STEP S133, the image formation performance unit 140 acquires control parameters appropriate for the kind "PHOTOSENSITIVE MEMBER A", from the storage unit 190.

Meanwhile, in a case where the comparison value D1 is not larger than the threshold value Vth ("No" in STEP S131), in STEP S134, the photosensitive-member identifying unit 130 identifies the kind of the photosensitive drums 51 as "PHOTOSENSITIVE MEMBER B". Thereafter, in STEP S135, the image formation performance unit 140 acquires control parameters appropriate for the kind "PHOTOSENSITIVE MEMBER B", from the storage unit 190.

Next, in STEP S136, the image formation performance unit 140 performs image forming by use of the control parameters acquired according to the kind of the photosensitive drums 51.

As described above, according to the color printer 1 of the present illustrative embodiment, it is possible to identify whether the kind of the photosensitive drums 51 is "PHOTOSENSITIVE MEMBER A" or "PHOTOSENSITIVE MEMBER B", and obtain an appropriate image forming operation according to the kind of the photosensitive drums 51. Further, if the photosensitive drums 51 are identified like in the present illustrative embodiment, since it is unnecessary to incorporate information for identifying each photosensitive drum 51 into the corresponding photosensitive drum 51 in order to identify the photosensitive drums 51, it is possible to identify the photosensitive drums 51 by a simple configuration.

Furthermore, in the present illustrative embodiment, since the photosensitive-member identifying unit 130 identifies the photosensitive drums 51 by use of the comparison value D1 which is a value correlated with the slopes of graphs illustrating the current-voltage characteristics during non-exposure and during full width exposure, it is possible to accurately identify the photosensitive drums 51 without receiving an influence of humidity so much.

Also, in the present illustrative embodiment, since the transfer rollers 74 which are generally included in an image forming apparatus are used as detecting members, it is possible to identify the photosensitive drums 51 without increasing the cost.

Further, in the color printer 1 of the present illustrative embodiment, the first ratio is set to 100%, and the second ratio is set to 0%, such that the difference between the first ratio and the second ratio is large. Therefore, it is possible to correctly identify the photosensitive members.

Furthermore, since the photosensitive drums 51 are separated from the photosensitive drums 51 when the test energization unit 120 applies electric power to the transfer rollers 74, the identifying process is performed in a state where toner is not on the first exposed section and the second exposed section. Therefore, the first to fourth voltages V1 to V4 is not influenced by toner, and thus it is possible to correctly identify the photosensitive drums 51.

Also, after a print job is received, the control unit 100 performs an operation of identifying the photosensitive drums 51 before an image forming operation is started. Then, image forming is performed by use of control parameters appropriate for the photosensitive drums 51. Therefore, it is possible to form a good image.

Figure 6:
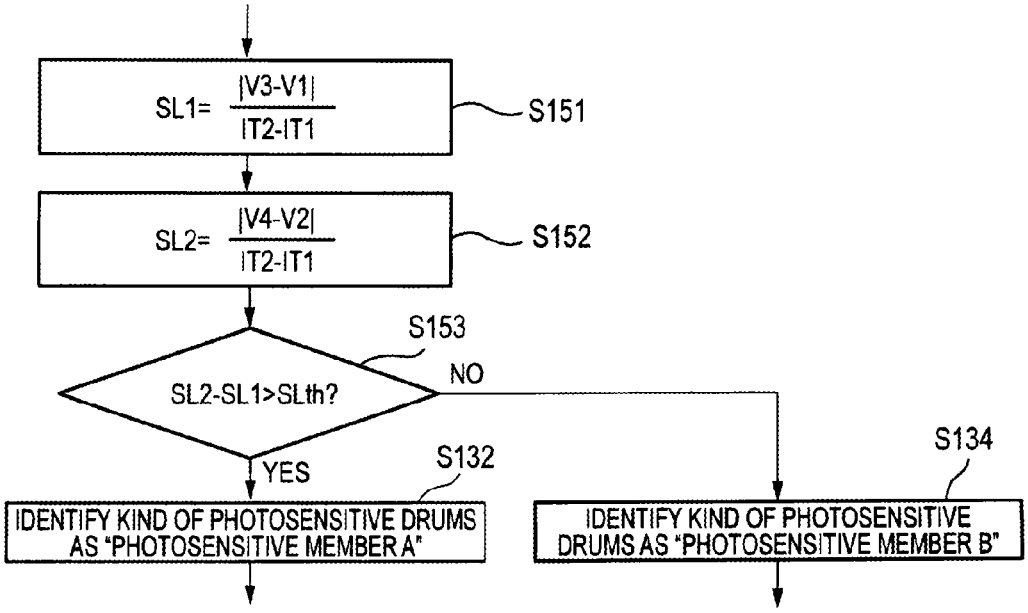
FIG. 6 is a flow chart illustrating another example of the photosensitive member identifying process according to the first illustrative embodiment.

Further, in the present illustrative embodiment, the comparison value D1 is used to identify the photosensitive drums 51. However, as shown in FIG. 6, the slopes of the graphs illustrating the current-voltage characteristics of the transfer rollers 74 may be calculated, and then be used to identify the photosensitive drums 51. STEPS S151 to S153 of the flow chart shown in FIG. 6 are processes which are performed in place of STEPS S130 and S131 of FIG. 5.

Now, the processes of STEPS S151 to S153 will be described. First, in STEP S151, the photosensitive-member identifying unit 130 calculates a slope SL1 during non-exposure as follows.

$$SL1=|V3-V1|/(IT2-IT1)$$

Subsequently, in STEP S152, the photosensitive-member identifying unit 130 calculates a slope SL2 during full width exposure as follows.

$$SL2=|V4-V2|/(IT2-IT1)$$

Thereafter, in STEP S153, the photosensitive-member identifying unit 130 compares a slope difference obtained by subtracting the slope SL1 from the slope SL2, with a predetermined threshold value SLth. If the slope difference is larger than the threshold value SLth, in STEP S132, the photosensitive-member identifying unit 130 identifies the kind of the photosensitive drums 51 as "PHOTOSENSITIVE MEMBER A". Meanwhile, if the slope difference is not larger than the threshold value SLth, in STEP S134, the photosensitive-member identifying unit 130 identifies the kind of the photosensitive drums 51 as "PHOTOSENSITIVE MEMBER B". Even if the slopes SL1 and SL2 are calculated as described above, it is possible to identify the photosensitive drums 51 like in the present illustrative embodiment.

As described above, if the photosensitive members are exposed, the surface potentials of the photosensitive members vary. Therefore, flowability of a current differs between an exposed portion and an unexposed portion. Also, this flowability depends on the magnitude of a current flowing between the photosensitive members and the detecting members. The inventors of this disclosure discovered that in a case of applying two currents having different current values between the photosensitive members and the detecting members, a difference in voltage in the first exposed section (the difference between the first voltage and the third voltage) and a difference in voltage in the second exposed section (the difference between the second voltage and the fourth voltage) depend on the kind of the photosensitive members. Therefore, if the photosensitive-member identifying unit for identifying the photosensitive members based on the first to fourth voltages is provided in the controller of the image forming apparatus, it is possible to identify the photosensitive members and obtain an appropriate image forming operation according to the photosensitive members. Therefore, in the image forming apparatus of this disclosure, the photosensitive members are identified, and values appropriate for the photosensitive members are selected as control parameters for image forming, whereby it is possible to form a good image. Further, in this configuration, in order to identify the photosensitive members, it is unnecessary to incorporate information for identifying each photosensitive member into the corresponding photosensitive member. Therefore, it is possible to identify the photosensitive members by a simple configuration.

Second Embodiment

Subsequently, a second illustrative embodiment of this disclosure will be described. The second illustrative embodiment is obtained by partially changing the photosensitive member identifying process. Therefore, with respect to the configuration of the color printer 1, only differences of the control unit 100 from that of the first illustrative embodiment will be described, and the others will not be described.

In the second illustrative embodiment, the test energization unit 120 is configured to apply a transfer bias to the transfer rollers 74 by constant voltage control during test energization, and acquire a current flowing at that moment. That is, the test energization unit 120 performs constant voltage control on the transfer rollers 74, thereby acquiring a first current I1 in a case of applying a first test voltage VT1 to the first exposed section, a second current I2 in a case of applying the first test voltage VT1 to the second exposed section, a third current I3 in a case of applying a second test voltage VT2 larger than the first test voltage VT1 to the first exposed section, and a fourth current I4 in a case of applying the second test voltage VT2 to the second exposed section. Thereafter, the test energization unit 120 outputs the acquired first to fourth currents I1 to I4 to the photosensitive-member identifying unit 130.

The photosensitive-member identifying unit 130 identifies the photosensitive members based on the first current I1, the second current I2, the third current I3, and the fourth current I4 acquired by the test energization unit 120. In the present illustrative embodiment, in order to compare the difference between the first current I1 and the second current I2, and the difference between the third current I3 and the fourth current I4, the photosensitive-member identifying unit 130 calculates a comparison value D2 as follows.

$$D2=|I1-I2|-|I3-I4|$$

Thereafter, the photosensitive-member identifying unit 130 compares the comparison value D2 with a predetermined threshold value Ith. In a case where the comparison value D2 is larger than the threshold value Ith, the photosensitive-member identifying unit 130 identifies the kind of the photosensitive drums 51 as "PHOTOSENSITIVE MEMBER A". Meanwhile, in a case where the comparison value D2 is not larger than the threshold value Ith, the photosensitive-member identifying unit 130 identifies the kind of the photosensitive drums 51 as "PHOTOSENSITIVE MEMBER B".

Also, in the present illustrative embodiment, when the test energization unit 120 applies electric power to the transfer rollers 74, instead of separating the developing rollers 53 from the photosensitive drums 51, a developing bias is suppressed from being applied to the developing rollers 53, whereby toner is suppressed from moving from the developing rollers 53 onto the photosensitive drums 51.

An operation which is performed for identifying the photosensitive drums 51 in the color printer 1 of the second illustrative embodiment configured as described above will be described. Here, a case where the photosensitive drums 51 are identified if the upper cover 12 is closed will be described.

Figure 7:
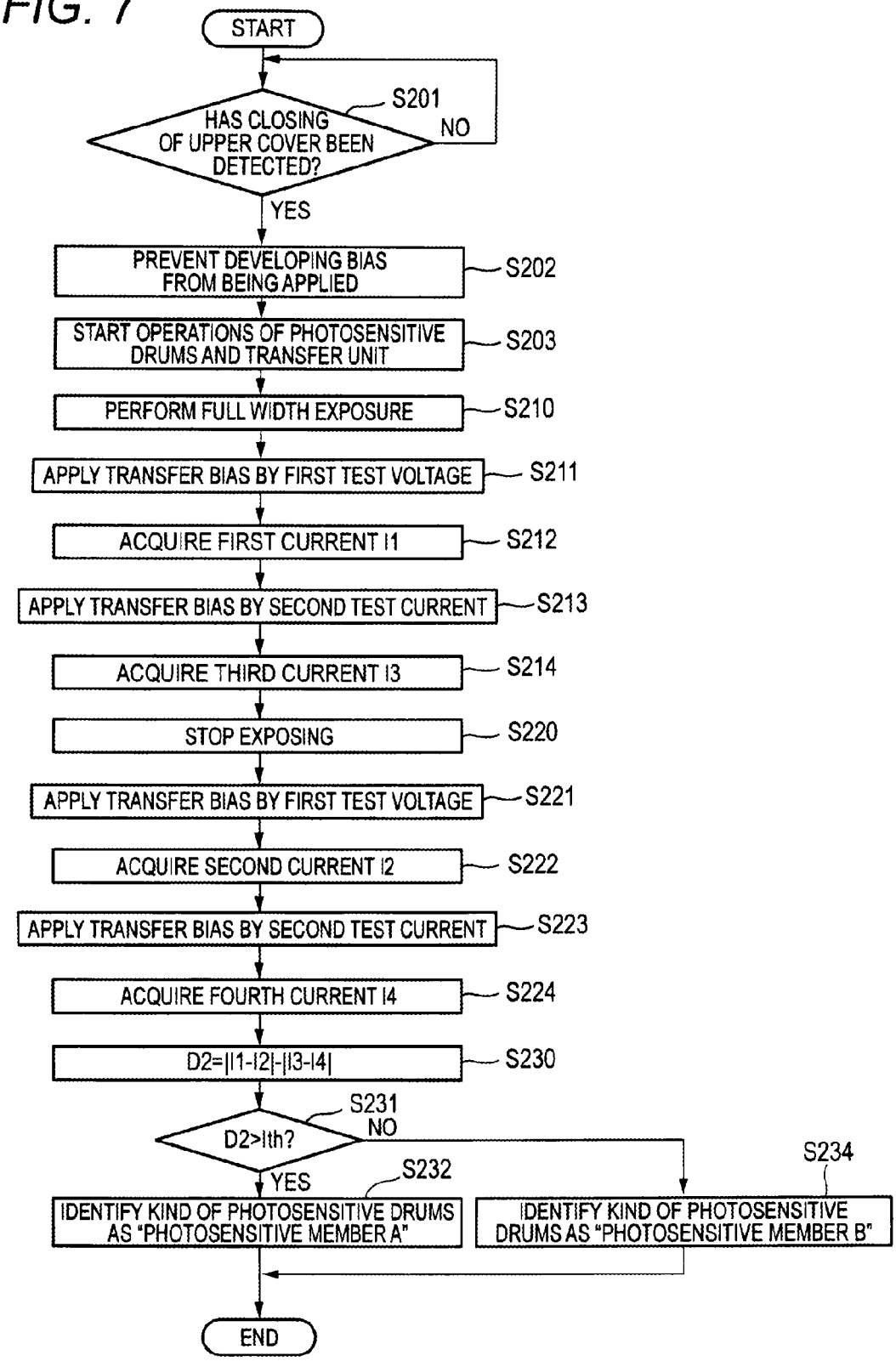
FIG. 7 is a flow chart illustrating a photosensitive member identifying process which is performed according to a second illustrative embodiment in a case of receiving a print job.

As shown in FIG. 7, if the cover sensor 103 detects closing of the upper cover 12 ("Yes" in STEP S201), the color printer 1 performs STEPS S202 to S234 which are processes for identifying the photosensitive drums 51. First, in STEP S202, the control unit 100 maintains a state where a developing bias is not applied to the developing rollers 53. As a result, toner is suppressed from moving from the developing rollers 53 onto the photosensitive drums 51 during the processes for identifying the photosensitive drums 51.

Subsequently, in STEP S202, the control unit 100 starts the operations of the photosensitive drums 51 and the transfer unit 70. Here, the operations of the photosensitive drums 51 and the transfer rollers 74 are the rotating operations of the photosensitive drums 51 and the transfer rollers 74, not operations for image forming. Also, at this time, a charging bias is applied to the chargers 52.

Figure 8A:
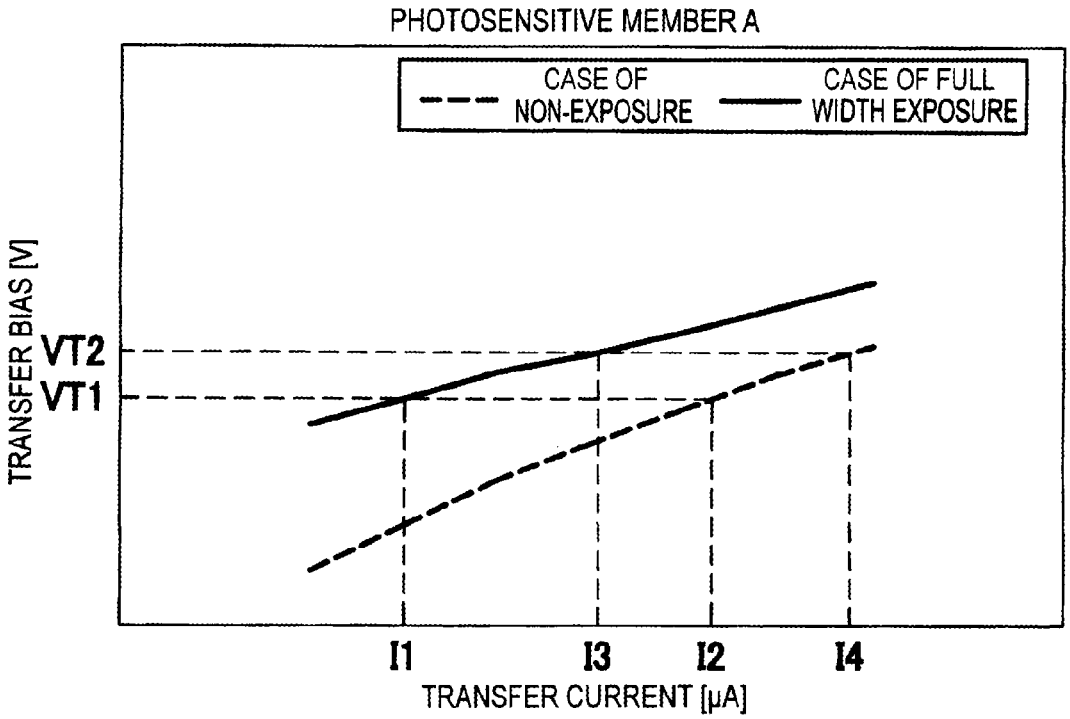
FIGS. 8A and 8B are views for explaining identification of photosensitive members according to the second illustrative embodiment, and more specifically.
Figure 8B:
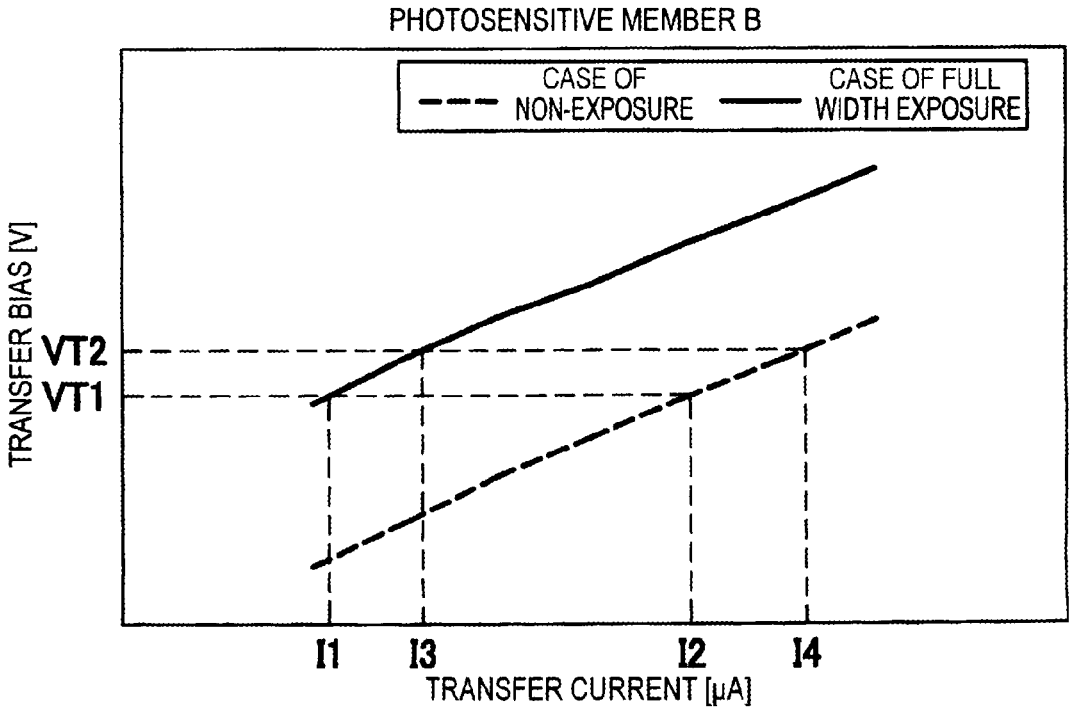

Next, in STEP S210, the test exposure unit 110 controls the LED unit 40 such that the full width of each photosensitive drum 51 to the scan width is exposed. While exposure is performed, the test energization unit 120 performs constant voltage control on the transfer rollers 74 by the first test voltage VT1, thereby applying a transfer bias, in STEP S211, and then acquires the first current I1 at that moment in STEP S212 (see also FIGS. 8A and 8B). Thereafter, the test energization unit 120 performs constant voltage control on the transfer rollers 74 by the second test voltage VT2, thereby applying a transfer bias, in STEP S213, and then acquires the third current I3 at that moment in STEP S214 (see also FIGS. 8A and 8B).

Next, in STEP S220, the test exposure unit 110 controls the LED unit 40, thereby stopping exposing of the photosensitive drums 51. Then, in a state where the exposing has been stopped, the test energization unit 120 performs constant voltage control on the transfer rollers 74 by the first test voltage VT1, thereby applying a transfer bias, in STEP S221, and then acquires the second current I2 at that moment in STEP S222 (see also FIGS. 8A and 8B). Thereafter, the test energization unit 120 performs constant voltage control on the transfer rollers 74 by the second test voltage VT2, thereby applying a transfer bias, in STEP S223, and then acquires the fourth current I4 at that moment in STEP S224 (see also FIGS. 8A and 8B).

If the test energization unit 120 acquires the first to fourth currents I1 to I4 in the above described way, in STEP S230, the photosensitive-member identifying unit 130 calculates the comparison value D2 as follows.

$$D2=|I1-I2|-|I3-I4|$$

Next, in STEP S231, the photosensitive-member identifying unit 130 compares the comparison value D2 with the threshold value Ith. In a case where the comparison value D2 is larger than the threshold value Ith ("Yes" in STEP S231), in STEP S232, the photosensitive-member identifying unit 130 identifies the kind of the photosensitive drums 51 as "PHOTOSENSITIVE MEMBER A". Meanwhile, in a case where the comparison value D2 is not larger than the threshold value Ith ("No" in STEP S231), in STEP S234, the photosensitive-member identifying unit 130 identifies the kind of the photosensitive drums 51 as "PHOTOSENSITIVE MEMBER B".

As described above, if transfer biases are applied to the transfer rollers 74 by constant voltage control during test energization and currents flowing at those moments are acquired, it is possible to identify the photosensitive drums 51. Also, in a case where the upper cover 12 is closed, the photosensitive drums 51 may be new. Therefore, in this case, if the processes for identifying the photosensitive drums 51 are performed, it is possible to form a good image.

Figure 9:
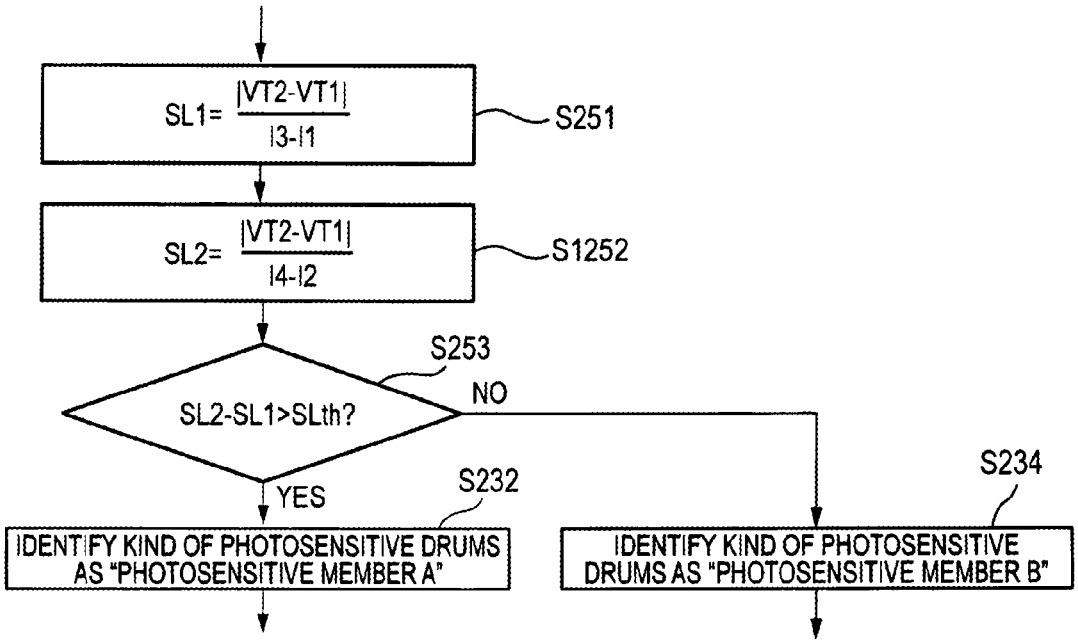
FIG. 9 is a flow chart illustrating another example of the photosensitive member identifying process according to the second illustrative embodiment.

Also, similarly in the first illustrative embodiment, even in the second illustrative embodiment, as shown in FIG. 9, the slopes of the graphs illustrating the current-voltage characteristics of the transfer rollers 74 may be calculated, and then be used to identify the photosensitive drums 51. STEPS S251 to S253 of the flow chart shown in FIG. 9 are processes which are performed in place of STEPS S230 and S231 of FIG. 7.

Now, the processes of STEPS S251 to S253 will be described. First, in STEP S251, the photosensitive-member identifying unit 130 calculates a slope SL1 during non-exposure as follows.

$$SL1=|VT2-VT1|/(I3-I1)$$

Subsequently, in STEP S252, the photosensitive-member identifying unit 130 calculates a slope SL2 during full width exposure as follows.

$$SL2=|VT2-VT1|/(I4-I2)$$

Thereafter, in STEP S253, the photosensitive-member identifying unit 130 compares a slope difference obtained by subtracting the slope SL1 from the slope SL2, with a predetermined threshold value SLth. If the slope difference is larger than the threshold value SLth, in STEP S232, the photosensitive-member identifying unit 130 identifies the kind of the photosensitive drums 51 as "PHOTOSENSITIVE MEMBER A". Meanwhile, if the slope difference is not larger than the threshold value SLth, in STEP S234, the photosensitive-member identifying unit 130 identifies the kind of the photosensitive drums 51 as "PHOTOSENSITIVE MEMBER B". Even if the slopes SL1 and SL2 are calculated as described above, it is possible to identify the photosensitive drums 51.

As described above, if the photosensitive members are exposed, the surface potentials of the photosensitive members vary. Therefore, flowability of a current differs between an exposed portion and an unexposed portion. Also, this flowability depends on the magnitude of a current flowing between the photosensitive members and the detecting members. Therefore, in a case of applying two voltages having different voltage values such that currents flow between the photosensitive members and the detecting members, a difference in current in the first exposed section (the difference between the first current and the third current) and a difference in current in the second exposed section (the difference between the second current and the fourth current) depend on the kind of the photosensitive members. Therefore, if the photosensitive-member identifying unit for identifying the photosensitive members based on the first to fourth currents is provided in the controller of the image forming apparatus, it is possible to identify the photosensitive members and obtain an appropriate image forming operation according to the photosensitive members. Therefore, in the image forming apparatus of this disclosure, the photosensitive members are identified, and values appropriate for the photosensitive members are selected as control parameters for image forming, whereby it is possible to form a good image. Further, in this configuration, in order to identify the photosensitive members, it is unnecessary to incorporate information for identifying each photosensitive member into the corresponding photosensitive member. Therefore, it is possible to identify the photosensitive members by a simple configuration.

Third Embodiment

Subsequently, a third illustrative embodiment of this disclosure will be described. The third illustrative embodiment is obtained by applying this disclosure to a method of manufacturing an image forming apparatus, and a color printer 1 of the third illustrative embodiment has almost the same configuration as that of the first illustrative embodiment, except that in a case of the kind "PHOTOSENSITIVE MEMBER A" of FIG. 4A, the photosensitive drums 51 are identified as an accepted product, and in a case of the kind "PHOTOSENSITIVE MEMBER B" of FIG. 4B, the photosensitive drums 51 are identified as a rejected product.

Figure 10:
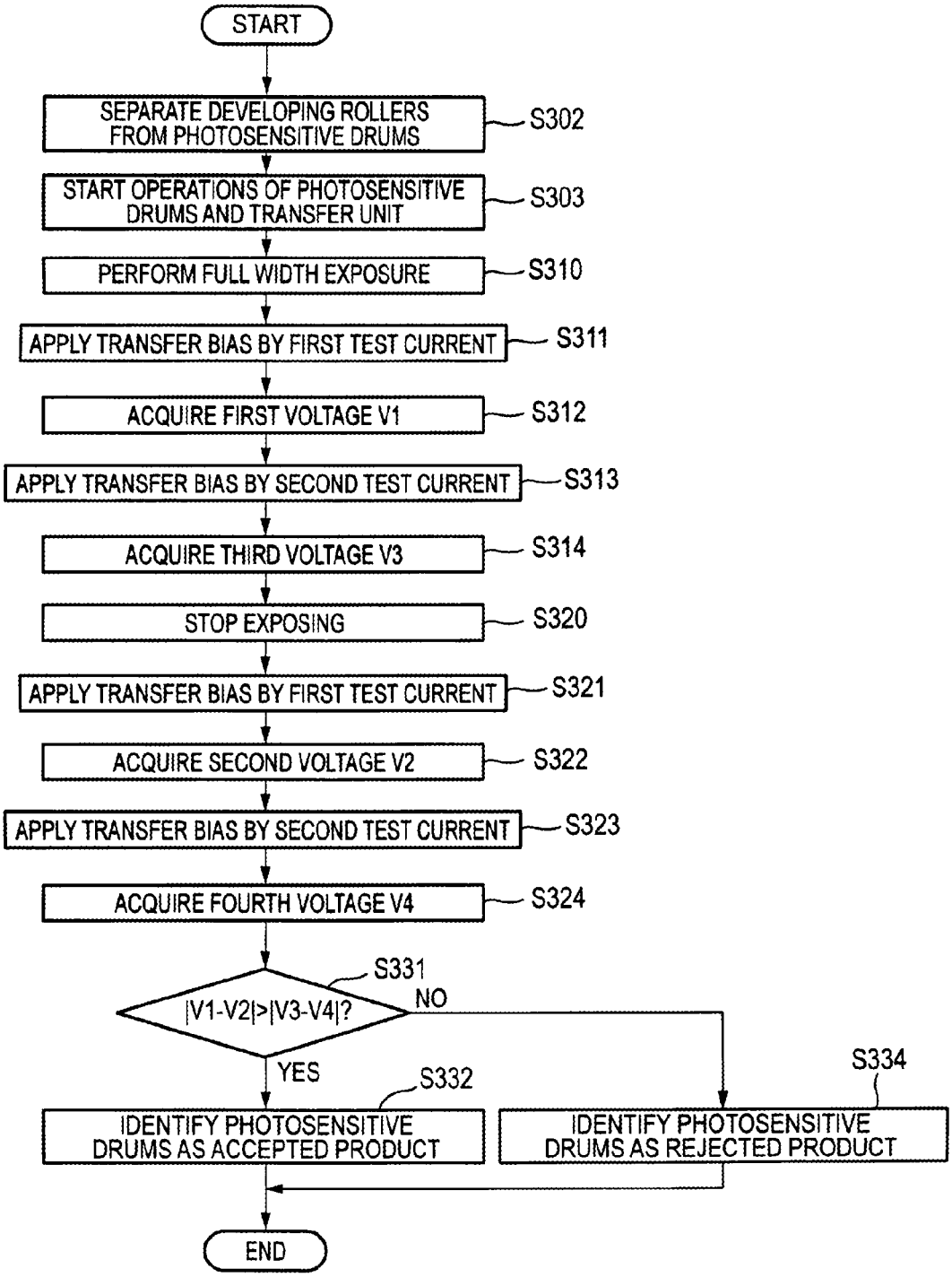
FIG. 10 is a flow chart illustrating a method of manufacturing an image forming apparatus according to a third illustrative embodiment.

During a test after assembling, if the color printer 1 is made perform an identifying process, the color printer 1 performs processes shown in FIG. 10.

As shown in FIG. 10, in STEP S302, the color printer 1 separates the developing rollers 53 from the photosensitive drums 51. As a result, during a process of identifying the photosensitive drums 51, toner is surely suppressed from moving from the developing rollers 53 onto the photosensitive drums 51.

Next, in STEP S302, the control unit 100 starts the operations of the photosensitive drums 51 and the transfer rollers 74. Here, the operations of the photosensitive drums 51 and the transfer rollers 74 are the rotating operations of the photosensitive drums 51 and the transfer rollers 74, not operations for image forming. Also, at this time, a charging bias is applied to the chargers 52.

Next, in STEP S310, the test exposure unit 110 controls the LED unit 40 such that the full width of each photosensitive drum 51 to the scan width is exposed. While exposure is being performed, the test energization unit 120 performs constant current control on the transfer rollers 74 by the first test current IT1, thereby applying a transfer bias, in STEP S311, and then acquires the first voltage V1 at that moment in STEP S312. Thereafter, the test energization unit 120 performs constant current control on the transfer rollers 74 by the second test current IT2, thereby applying a transfer bias, in STEP S313, and then acquires the third voltage V3 at that moment in STEP S314.

Next, in STEP S320, the test exposure unit 110 controls the LED unit 40, thereby stopping exposing of the photosensitive drums 51. Then, in a state where the exposing has been stopped, the test energization unit 120 performs constant current control on the transfer rollers 74 by the first test current IT1, thereby applying a transfer bias, in STEP S321, and then acquires the second voltage V2 at that moment in STEP S322. Thereafter, the test energization unit 120 performs constant current control on the transfer rollers 74 by the second test current IT2, thereby applying a transfer bias, in STEP S323, and then acquires the fourth voltage V4 at that moment in STEP S324.

If the test energization unit 120 acquires the first to fourth voltages V1 to V4 in the above described way, in STEP S331, the photosensitive-member identifying unit 130 compares a value of |V1−V2| with a value of |V3−V4|. If the value of ÅV1−V2| is larger than the value of |V3−V4| ("Yes" in STEP S331), in STEP S332, the photosensitive-member identifying unit 130 identifies the photosensitive drums 51 as accepted product. Meanwhile, if the value of |V1−V2| is not larger than the value of |V3−V4| ("No" in STEP S331), in STEP S334, the image forming unit 30 identifies the photosensitive drums 51 as rejected product.

According to the method of manufacturing the color printer 1 as described above, it is possible to manufacture the color printer 1 using the photosensitive drums 51 wherein a change in transfer bias is small due to a change in transfer current during full width exposure, like the type "PHOTOSENSITIVE MEMBER A" shown in FIG. 4A. These photosensitive drums 51 are photosensitive members where a change in voltage is smaller due to a change in printing area ratio as compared to a normal photosensitive member. Therefore, in some cases, especially, in a case of performing constant voltage control, it is possible to perform good printing regardless of the printing area ratio.

According to this manufacturing method, it is possible to identify the photosensitive members by a simple method and manufacture an image forming apparatus. Further, in an image forming apparatus which is manufactured using an accepted product by this manufacturing method, the difference between the third voltage and the fourth voltage is smaller than the difference between the first voltage and the second voltage. Therefore, a change in voltage in the photosensitive members due to a change in printing area ratio is smaller than that of a normal photosensitive member, so it is possible to perform good printing regardless of the printing area ratio.

Modifications

Although illustrative embodiments of this disclosure have been described above, this disclosure is not limited to the above described illustrative embodiments and can be obtained by appropriately modifying the above described illustrative embodiments.

For example, in each of the above described illustrative embodiments, as the photosensitive members, the photosensitive drums 51 have been exemplified. However, the photosensitive members may be of a belt type.

In each of the above described illustrative embodiments, as the detecting members, the transfer rollers 74 have been exemplified. However, the detecting members may be the cleaning rollers 57.

In each of the above described illustrative embodiments, the detecting members include an ion conductive material. However, the detecting members may include a material having conductivity due to electrons, such as rubber containing carbon.

In the above described illustrative embodiments, as an image forming apparatus, the color printer 1 capable of color printing has been exemplified. However, the image forming apparatus may be a printer capable of only monochrome printing. Also, the image forming apparatus is not limited to a printer, and may be any other apparatus such as a copy machine or a multi-function apparatus having a document reading device such as a flatbed scanner.

What is claimed is:

1. An image forming apparatus including a photosensitive member, a charger configured to charge the photosensitive member, an exposing unit configured to expose the photosensitive member, a developing member configured to supply developer to the photosensitive member, an image forming unit that includes a detecting member configured to flow current between the detecting member and the photosensitive member, a controller configured to control operations of the image forming unit, and a casing, the image forming apparatus being configured to identify the photosensitive member, wherein the controller performs operations comprising:

controlling the exposing unit to expose a first ratio to a full scan width of the photosensitive member to thereby form a first exposed section, and to expose a second ratio smaller than the first ratio to thereby form a second exposed section, controlling the detecting member to acquire:

a first voltage in a case where a first test current flows in the first exposed section;

a second voltage in a case where the first test current flows in the second exposed section;

a third voltage in a case where a second test current larger than the first test current flows in the first exposed section; and a fourth voltage in a case where the second test current flows in the second exposed section; and identifying the photosensitive member based on the first to fourth voltages.

2. The image forming apparatus according to claim 1, wherein a photosensitive-member identifying unit compares a difference between the first voltage and the second voltage and a difference between the third voltage and the fourth voltage, to thereby identify the photosensitive member.

3. The image forming apparatus according to claim 1, wherein a photosensitive-member identifying unit compares a slope in a current-voltage characteristic of the first exposed section obtained based on the first voltage and the third voltage and a slope in the current-voltage characteristic of the second exposed section obtained based on the second voltage and the fourth voltage, to thereby identify the photosensitive member.

4. The image forming apparatus according to claim 1, wherein the detecting member is a transfer member transferring developer images on the photosensitive member, onto a transfer medium passing between the photosensitive member and the detecting member.

5. The image forming apparatus according to claim 4, wherein the transfer member are configured to include an ion conductive material.

6. The image forming apparatus according to claim 1, wherein the first ratio is 100%, and the second ratio is 0%.

7. The image forming apparatus according to claim 1, wherein the controller controls the developing member to be separated from the photosensitive member when the controller applies electric power to the detecting member.

8. The image forming apparatus according to claim 1, wherein the controller controls a potential of the developing member to suppress the developer from moving from the developing member onto the photosensitive member when the controller applies electric power to the detecting member.

9. The image forming apparatus according to claim 1, wherein after a print job is received, the controller performs an operation of identifying the photosensitive member, before an image forming operation starts.

10. The image forming apparatus according to claim 1, further comprising:

a cover member configured to open and close a portion of the casing; and a sensor configured to detect opening-and-closing state of the cover member, wherein in a case where the sensor detects closing of the cover member, the controller performs an operation of identifying the photosensitive member.

11. An image forming apparatus including a photosensitive member, a charger configured to charge the photosensitive member, an exposing unit configured to expose the photosensitive member, a developing member configured to supply developer to the photosensitive member, an image forming unit that includes a detecting member configured to flow current between the detecting member and the photosensitive member, and a controller configured to control operations of the image forming unit, the image forming apparatus being configured to identify the photosensitive member, wherein the controller performs operations comprising:

controlling the exposing unit to expose a first ratio to a full scan width of the photosensitive member to thereby form a first exposed section, and to expose a second ratio smaller than the first ratio to thereby form a second exposed section, controlling the detecting member to acquire:

a first current in a case of applying a first test voltage to the first exposed section;

a second current in a case of applying the first test voltage to the second exposed section;

a third current in a case of applying a second test voltage larger than the first test voltage to the first exposed section; and a fourth current in a case of applying the second test voltage to the second exposed section; and identifying the photosensitive member based on the first to fourth currents.

12. The image forming apparatus according to claim 11, wherein a photosensitive-member identifying unit compares a difference between the first current and the second current and a difference between the third current and the fourth current, to thereby identify the photosensitive member.

13. The image forming apparatus according to claim 11, wherein the photosensitive member identifying unit compares a slope in the current-voltage characteristic of the first exposed section obtained based on the first current and the third current and a slope in the current-voltage characteristic of the second exposed section obtained based on the second current and the fourth current, to thereby identify the photosensitive member.

14. A method of manufacturing an image forming apparatus including a photosensitive member, a charger configured to charge the photosensitive member, an exposing unit configured to expose the photosensitive member, a developing member configured to supply developer to the photosensitive member, an image forming unit that includes a detecting member configured to flow current between the detecting member and the photosensitive member, the method comprising:

controlling the exposing unit to expose a first ratio to a full scan width of the photosensitive member to thereby form a first exposed section;

controlling the detecting member to acquire a first voltage in a case where a first current flows in the first exposed section and a third voltage in a case where a second current larger than the first current flows in the first exposed section;

controlling the exposing unit to expose a second ratio to the full scan width of the photosensitive member, to thereby form second exposed section, the second ratio being smaller than the first ratio;

controlling the detecting member to acquire a second voltage in a case where the first current flows in the second exposed section and a fourth voltage in a case where the second current flows in the second exposed section;

identifying, in a case where a difference between the first voltage and the second voltage is smaller than a difference between the third voltage and the fourth voltage, the photosensitive member as an accepted product; and identifying, in a case where the difference between the first voltage and the second voltage is not smaller than the difference between the third voltage and the fourth voltage, the photosensitive member as a rejected product.

* * * * *